United States Patent [19]

Wallasch et al.

[11] 4,356,583

[45] Nov. 2, 1982

[54] LIQUID-OPERATED RECIPROCATING PRIME MOVER ASSEMBLY AND BODY WASHING APPARATUS INCORPORATING SAME

[76] Inventors: Lutz Wallasch, 1036 Archer Pl., Baldwin, N.Y. 11510; Helmut K. Grundler, 74 E. Valley Stream Blvd., Valley Stream, N.Y. 11580

[21] Appl. No.: 243,245

[22] Filed: Mar. 12, 1981

[51] Int. Cl.[3] ..... A47K 7/04

[52] U.S. Cl. ..... 15/21 E; 91/229; 91/338; 91/341 R; 128/56

[58] Field of Search ..... 15/21 R, 21 E, 97 R; 91/229, 338, 341 R; 128/53, 56

[56] References Cited

U.S. PATENT DOCUMENTS

| | | | |
|---|---|---|---|
| 1,082,635 | 12/1913 | Irwin | 91/229 |
| 1,254,644 | 1/1918 | Allen | 91/229 |
| 3,768,462 | 10/1973 | Boulard | 15/21 R |

FOREIGN PATENT DOCUMENTS

| | | | |
|---|---|---|---|
| 2429808 | 1/1976 | Fed. Rep. of Germany | 128/56 |

*Primary Examiner*—Edward L. Roberts

*Attorney, Agent, or Firm*—Jordan B. Bierman; Linda G. Bierman

[57] ABSTRACT

A liquid-operated reciprocating prime mover assembly includes upper and lower reservoirs formed of interlocking cylinders enabling relative expansion and contraction of the interior volumes thereof, and a shuttle valve disposed intermediately and connectingly between the upper and lower reservoirs for receiving a stream of operating liquid and directing the same alternatingly between the reservoirs. As the liquid is directed to each reservoir that reservoir is caused to expand, carrying the shuttle valve in a first direction along a rectilinear path, while when fed to the other reservoir the liquid causes the valve to be correspondingly carried in the opposite direction along the path. A body washing apparatus incorporating the prime mover assembly further includes an operatively rotatable brush assembly carried along the rectilinear path and supporting a brush rotatable as the shuttle valve traverses the path for cleansing contact with a user's body.

20 Claims, 14 Drawing Figures

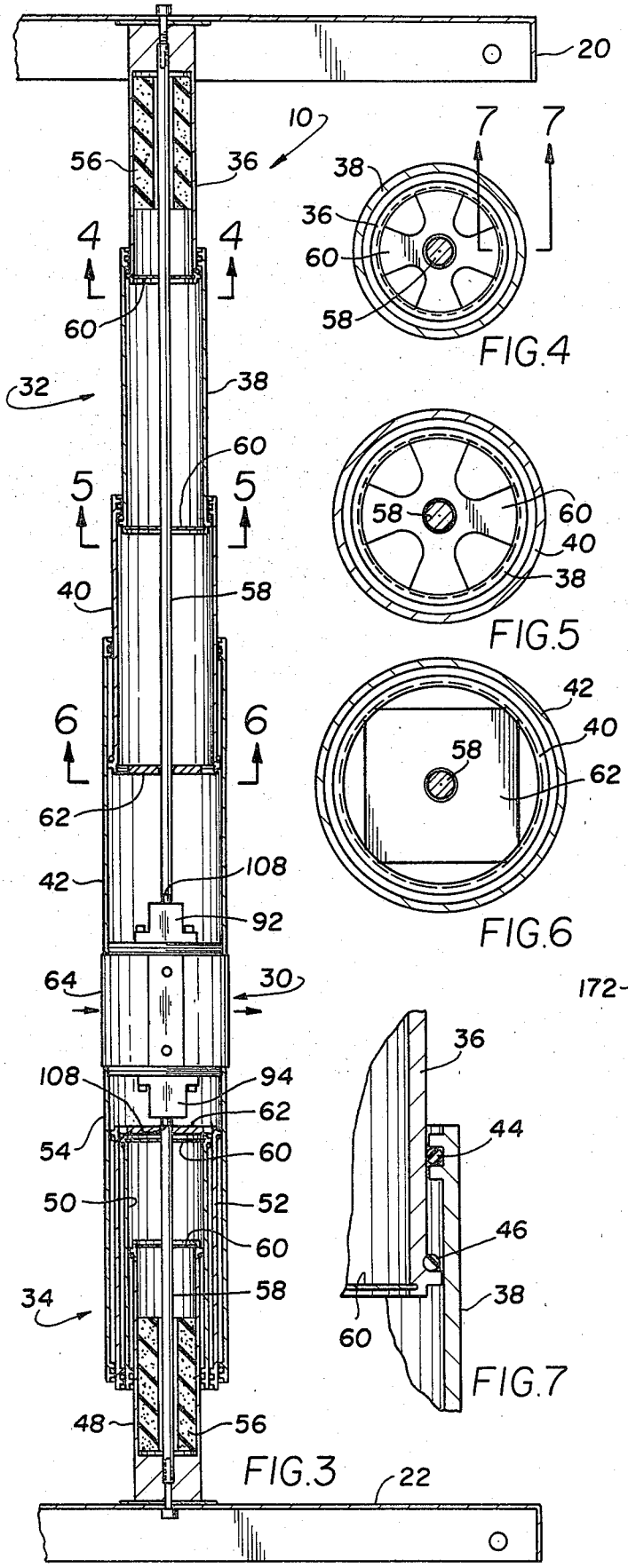
FIG.3
FIG.4
FIG.5
FIG.6
FIG.7
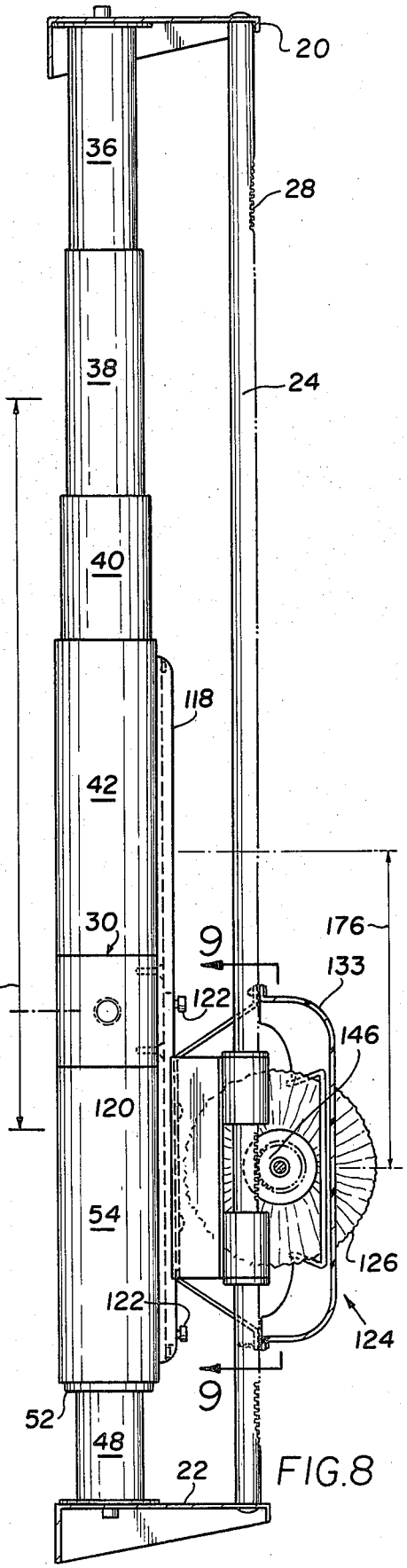
FIG.8

LIQUID-OPERATED RECIPROCATING PRIME MOVER ASSEMBLY AND BODY WASHING APPARATUS INCORPORATING SAME

BACKGROUND OF THE INVENTION

The present invention concerns a prime mover assembly operated by a liquid stream for reciprocatingly carrying a device along a rectilinear axis. The invention further relates to a body washing and massaging apparatus incorporating the inventive prime mover assembly.

There is often, in a wide variety of applications, a need to provide a particular device with reciprocal movability along a rectilinear axis. At times, there is a further requirement that the apparatus intended to enable such movement be usable in an environment in which the presence of fumes or fluids or certain conditions necessitate against powering of the apparatus with electricity or other commonly-utilized power sources. One such example of this situation occurs where the environment is extremely wet or damp such that the presence of electrical current presents a real risk and possibility of hazardous shock—as in a bathroom or, more particularly, in a shower stall or bathtub.

A more specific example involves the washing of one's own body, whereby great difficulty is almost always encountered in effectively cleansing the back due to the relatively short reach and extreme angular dexterity required of the arms. The same problem is well known among those suffering chronic or periodic back problems which can be alleviated by appropriate massaging manipulation of the concerned area, and massaging of the back even without a direct medical need therefor is almost universally recognized as providing mental benefits through physical loosening of tense back muscles. Of course, either of these situations can be satisfactorily attended to by another person, although the other's presence or willingness to assist whensoever necessary cannot always be depended upon.

Various devices have been proposed for use in a shower environment and to provide capabilities of this sort. U.S. Pat. No. 3,768,462 discloses a scrubbing and massaging apparatus for the human body including a scrubbing head movable along a vertical path. The scrubbing head is carried on a pair of cables driven by a pulley-type hydraulically-driven arrangement in which a liquid, such as water, alternately fills the top and bottom of a hollow cylinder to correspondingly move a piston contained therein. As the scrubbing head reaches the respective top and bottom of its desired path of travel, it engages limit stops secured on a rod for moving the rod and causing a reversal in the direction of head travel.

The apparatus of this prior art patent includes a number of distinct operating disadvantages, not the least of which is inherent in its use of cables and pulleys which are undesireably subject to stretching, breakage and slippage in the notably wet environment of a bathroom shower. As a consequence, the water pressure necessary to effectively operate the apparatus is undesireably great and its use can involve significant wasting of water supplies that are often inadequate to allow for such waste.

It is accordingly the desideratum of the present invention to provide a prime mover assembly capable of reciprocating a device along a rectilinear axis utilizing a relatively low pressure source of liquid for providing its operating power.

It is another object of the invention to provide apparatus for scrubbing and massaging a human body—and more particularly the back thereof—incorporating the inventive prime mover assembly.

It is further object of the invention to provide such a scrubbing and massaging device that is inherently reliable, utilizes component parts that are appropriate for use in a bathroom shower environment, and that is capable of providing long and substantially maintenance free operation for an extended period of time.

Other objects and features of the present invention will become apparent from the following detailed description considered in connection with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the drawing, wherein similar reference characters denote similar elements throughout the several views:

FIG. 3 is a front sectional elevation of a prime mover assembly in accordance with the invention as seen along the lines 3—3 in FIG. 1;

FIG. 4 is a cross-sectional view as seen along the lines 4—4 in FIG. 3;

FIG. 5 is a cross-sectional view as seen along the lines 5—5 in FIG. 3;

FIG. 6 is a cross-sectional view as seen along the lines 6—6 in FIG. 3;

FIG. 7 is a sectional detail as seen along the lines 7—7 in FIG. 4;

FIG. 8 is a side elevational section of the body washing apparatus as seen along the lines 8—8 in FIG. 2;

DETAILED DESCRIPTION OF THE PREFERRED EMBODIMENTS

Figure 1:
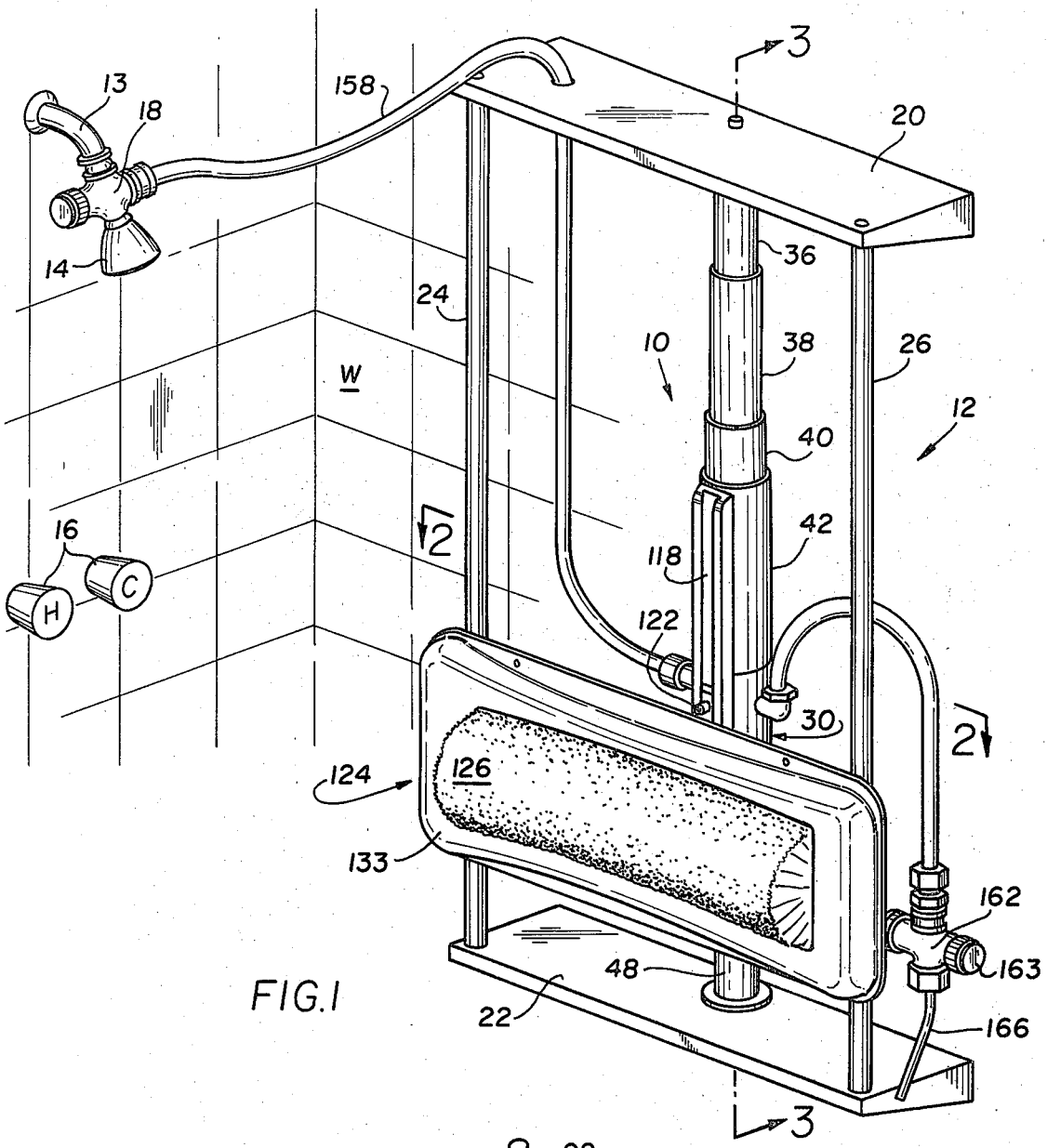
FIG. 1 is an elevated perspective view of a body washing and massaging apparatus incorporating and embodying a prime mover assembly constructed in accordance with the present teachings of the invention.

The present invention is generally directed to a fluid-operated prime mover assembly for reciprocating movement along a rectilinear axis as hereinafter described and disclosed. The invention more particularly concerns such an assembly which includes switching or shuttle valve means which is reciprocatingly moved along said axis and which is adapted to effect a reversal in the direction of its travel at the opposed limit points of its rectilinear movement. An exemplary embodiment of a prime mover assembly constructed in accordance with the teachings of the invention, and identified by the general reference numeral 10 is seen in FIG. 3.

A particularly noteworthy feature and intended use of the inventive assembly 10 lies in its ability to carry a desired work-producing or otherwise utility-oriented device through or along its rectilinear travel axis. For purposes of illustration, there is additionally disclosed an apparatus for massaging and facilitating washing or cleansing of a user's body and which structurally incorporates and embodies the inventive prime mover assembly 10. This apparatus, which for ease of reference and description is hereinafter referred to simply as a body washing apparatus, is designated by the general reference numeral 12 and may be seen in a typical operating environment therefor in FIG. 1.

Referring initially to FIG. 1, the unit 12 is shown operatively mounted as a fixture on a vertical wall W of a bath or shower stall. The shower stall will normally include a water feed pipe 13 terminating in a shower head 14 through which a user-controlled, pressure and temperature variable of water may be directed by appropriate manipulation of hot and cold water control faucets 16. The body washing unit 12 is connected to the water stream through a distribution valve 18 interposed between the head 14 and shower feed 13; the valve 18 is perferrably manually adjustable for selective variation of the relative water distribution between shower head 14 and the body washing unit or apparatus 12.

Figure 9:
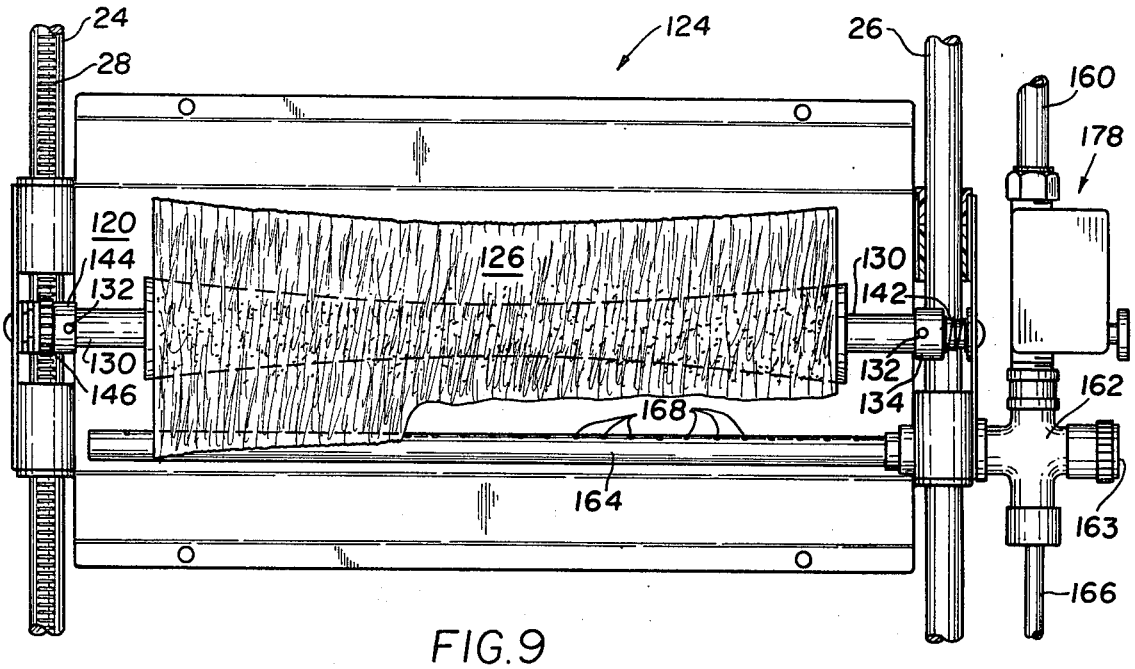
FIG. 9 is a front elevational view of the brush support housing as seen along the lines 9—9 in FIG. 8.

The washing apparatus 12 may be hung or suspended on the shower wall W by respective upper and lower mounting brackets 20, 22 respectively. In addition to the presence of prime mover assembly 10 connected spanningly therebetween in a manner hereinafter described, a pair of vertical guide rods 24, 26 couples the brackets 20, 22 and rigidly maintains their spaced-apart positional relation. As best seen in FIG. 9, guide rod 24 is provided with a power transfer rack 28 comprised of a series of regularly spaced grooves defined substantially perpendicular to its elongation; those skilled in the art will readily recognize, however, that either or both of the rods 24, 26 might alternatively carry rack 28 or a functional equivalent therefor.

Referring now to FIG. 3, the prime mover assembly 10 is seen to generally comprise an elongated assembly mounted vertically between upper and lower brackets 20, 22. The heart of the assembly 10 comprises a shuttle or switching valve 30 which is interposed adjoiningly between upper and lower liquid receiving and discharging reservoirs. Shuttle valve 30 includes switchable means for directing operating liquid fed to the valve to one reservoir in a first operation mode and to the other reservoir in a second operation mode, and reversing means on a valve 30 effects switching between the two modes. It should be particularly emphasized that although the shuttle valve 30 of the invention is operable utilizing any appropriate fluid—whether in a liquid of gaseous state or some combination thereof—the term "operating liquid" is generally used throughout the present description in order to facilitate understanding in the particular disclosed operating environment and application which employs water. No such limitation of the type or state of the operating fluid is accordingly intended.

Each of the upper and lower reservoirs—respectively designated 32, 34—is formed of a series of telescopically interengaging and relatively slidable hollow cylinders bounding an interior chamber for relative expansion and contraction of the reservoir as operating liquid is directed into and discharged from the same. In the operation of prime mover assembly 10, shuttle valve 30 is carried through reciprocating motion along the substantially rectilinear axis defined by the elongation of assembly 10 through alternating expansion and contraction of the upper and lower reservoirs 32, 34 as their interior liquid-containing volumetric extents mutually vary.

Upper reservoir 32 is formed of first, second, third, and fourth upper cylinders 36, 38, 40 and 42 respectively. As detailed in FIG. 7, possible leakage of reservoir-contained liquid from between adjacent and mutually interengaged ones of the cylinders may be substantially eliminated by the use of O-type sealing rings 44, and the further provision of bumper rings 46 will serve to reduce operating noise related to attainment of maximum reservoir expansion.

Similarly, lower reservoir 34 is delineated by the telescopingly coupled first, second, third, and fourth lower cylinders 48, 50, 52 and 54. It will be observed that fourth upper and fourth lower cylinders 42, 54 are each threadedly connected to the intermediately positioned shuttle valve 30, while first upper and first lower cylinders 36, 48 are disposed in the outermost positions along the rectilinear axis adjacent the respective mounting rackets 20, 22. Each of these first cylinders 36, 48 contains an air spring 56 which may comprise closed cell foam rubber.

A fixed support or rigidifying rod 58 extends spanningly between upper and lower mounting brackets 20, 22 to which it is secured at opposite ends and within the prime mover assembly 10. This rod 58 extends substantially centrally through each of the elements and structures of the assembly 10 including shuttle valve 30 and upper and lower reservoirs 32, 34. Each of the first and second, upper and lower cylinders is provided with an internally-mounted guide disk 60 having a centrally-defined aperture through which rod 58 is loosely journaled and a plurality of peripherally-disposed openings for enabling liquid distribution along the full interior of each reservoir. Similarly, the third upper and lower cylinders 40 and 52 each carry at their end facing the shuttle valve 30 a stop or switch plate 62 of substantially square or rectangular shape and including a rod-receiving central aperture. The somewhat different configurations of guide disks 60 and switch plates 62 are provided for reasons that will become apparent as this description proceeds although it should, in any event, be understood that the illustrated forms of disks 60 and plates 62 are intended to be merely by way of example and each may be implemented in any convenient and functionally-appropriate manner.

Figure 2:
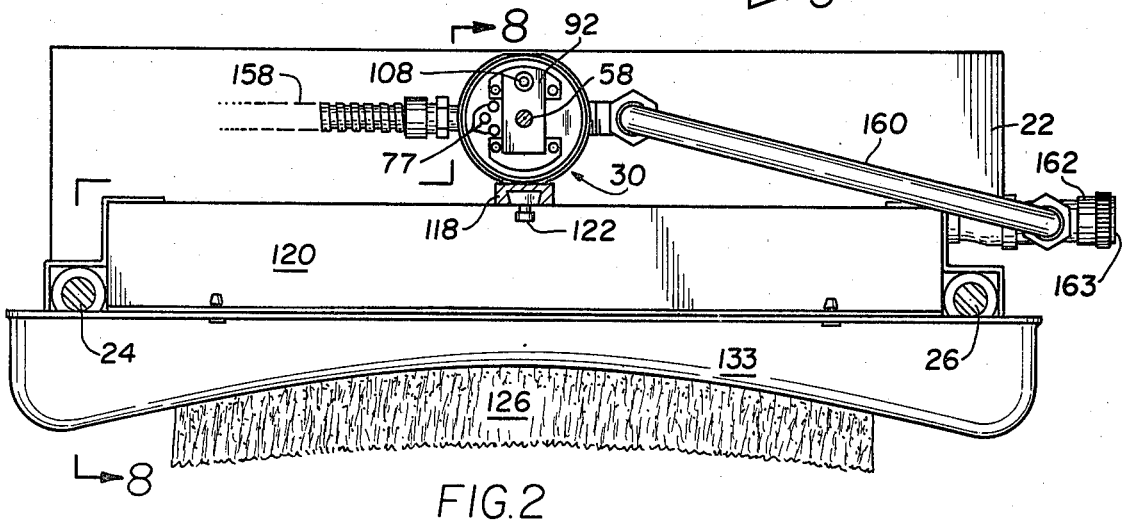
FIG. 2 is a plan section of the body washing apparatus as seen along the lines 2—2 in FIG. 1.
Figure 13:
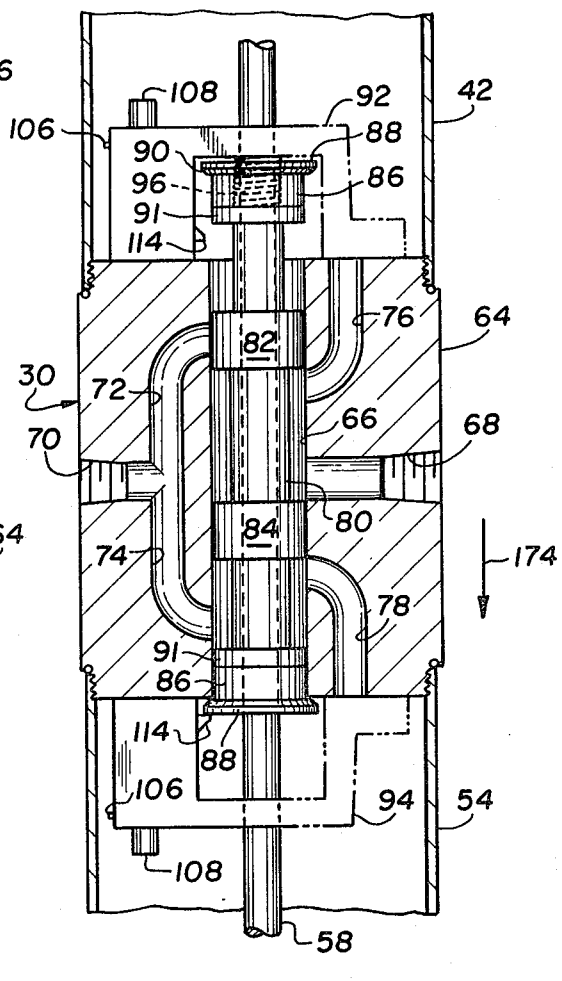
FIG. 13 is a front sectional view of the shuttle valve of the prime mover assembly in its second operative mode disposed for downwardly-directed movement.
Figure 12:
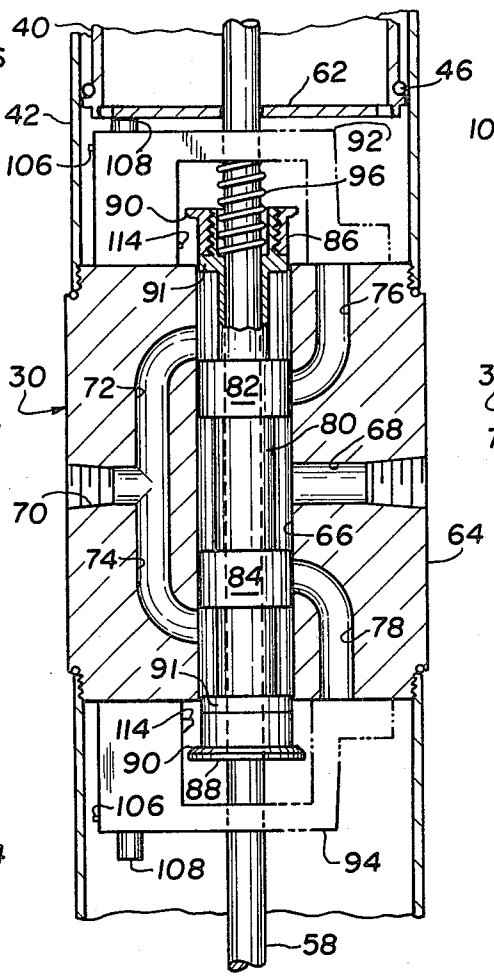
FIG. 12 is a front sectional view of the shuttle valve of the prime mover assembly shown in an intermediate switching condition between its two operative modes.
Figure 11:
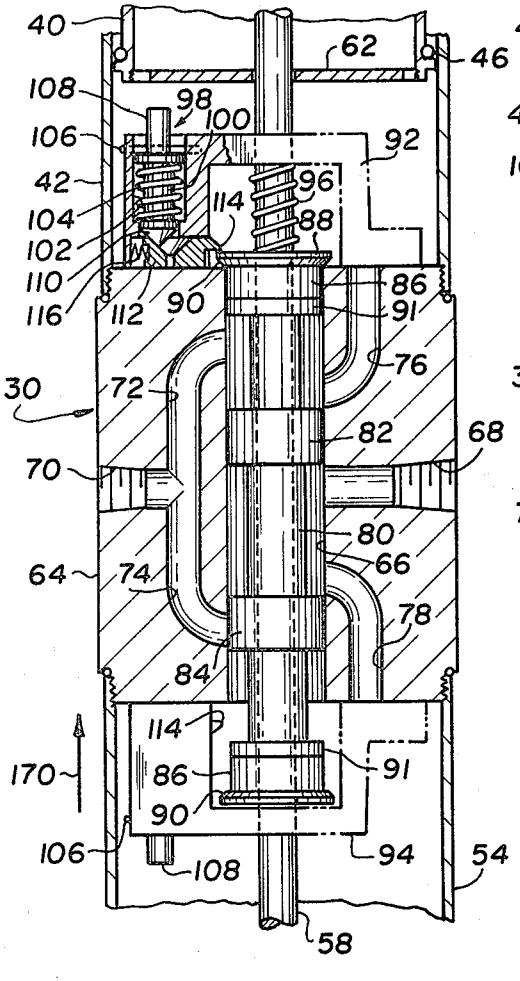
FIG. 11 is a front sectional view of the shuttle valve of the prime mover assembly in its first operative mode disposed for upwardly-directed movement.

The details of shuttle valve assembly 30 may best be seen in FIGS. 11, 12 and 13 which illustrate the two operative modes (FIGS. 11 and 13) of the valve and an intermediate switching condition (FIG. 12). A valve body 64 is provided with a plurality of openings and passages therein including a bore 66 axially defined through the central portion of body 64 and having a substantially constant cross-sectional diameter somewhat larger than that of rod 58 which passes therethrough. An inlet passage 68 provides a communication entry path for operating liquid from the body exterior to central throughbore 66, while an outlet 70 connects upper and lower discharge passages 72, 74 which communicate with axially-opposite portions of central bore 66. In addition, an upper feed passage 76 extends between the top or upper-disposed surface of valve body 64 and central bore 66, communication with the latter being at a point intermediate inlet passage 68 and the upper discharge passage 72. The upper-disposed end of feed passage 76 extends through the top surface of valve body 64 at apertures 77 (FIG. 2). Likewise, one end of a lower feed passage 78 communicates with central bore 66 intermediately between inlet passage 68 and lower discharge passage 74, extending at its other end to and through the bottom or lower-disposed surface of valve body 64.

A shuttle piston 80 is arranged for axial sliding movement within and along throughbore 66 of valve body 64. In the disclosed embodiment of the invention, piston 80 is implemented in the form of a spool-like structure. A hollow defined axially along piston 80 for its full length is sufficiently sized to receive central rod 58 in loosely journalled relation therethrough; thus, throughbore 66 of valve body 64 axially envelopes relatively slidable shuttle piston 80, which likewise axially envelopes fixed rod 58. Spool piston 80 includes a pair of spaced-apart switching portions, each comprised of an annular ring of relatively enlarged cross-section with respect to the remainder of piston 80. The upper and lower switching rings 82, 84 are sized for a relatively snug fit against the wall of bore 66 although it is necessary that piston 80 be readily slideable along the bore; piston 80—or at least switching rings 82, 84—may accordingly be formed of a material such as nylon which exhibits substantial self-lubricating properties to enable relatively free sliding travel. The spaced-apart positioning of switching rings 82, 84 along shuttle piston 80 enables predetermined distribution and switching of liquid directed through the valve 30 in a manner hereinafter described.

The cross-sectional diameter of a cylindrical end cap 86 carried on each end of the piston 80 is sized to substantially correspond to that of throughbore 66, and each cap 86 is provided with an outer flange or rim portion 88 of enlarged diameter which inwardly tapers at surface 90. Thus, each end cap is capable of being received within bore 66 to such extent that only its tapered surface 90 and rim 88 project outwardly of the bore. The diametric sizing of end caps 86 and the provision of rim portions 88 for overlying the open ends of throughbore 66 advantageously enable substantial sealing of bore 66 against undesired leakage-related liquid communication between its interior and the adjacently-disposed reservoirs 32, 34. End caps 86 may be internally threaded for achieving mutual coupling with the axially opposite ends of shuttle piston 80.

It should be noted that leakage-related sealing of the ends of throughbore 66 by the tapered rim portion 88 of caps 86 could alternatively or additionally be accomplished by the provision of a radially outwardly extended annular ring 91 provided proximate each end of piston 80 for abutment with the respective end cap 86. The inclusion of rings 91 enables the manufacturing tolerance of caps 86 to be reduced while advantageously increasing the available sealing capability at each end of throughbore 66.

The total elongation of shuttle piston 80 with end caps 86 attached is greater than that of valve body 64—and correspondingly of throughbore 66. As a consequence, end caps 86 are incapable of simultaneously sealing both open ends of the bore. In actual practice, it is contemplated and expected that substantially complete closure of either end of throughbore 66 will not occur until the respective end cap 86 is received to its maximum possible extent in the bore whereby its tapered surface 90 abuts the bore edge or rim. Thus, shuttle piston 80 is operatively movable or slidable between two opposed, limit positions (as shown in FIGS. 11 and 13)—each limit position providing substantially complete sealing closure of one of the throughbore ends and each corresponding to one of the aforementioned two operating modes of shuttle valve 30.

The top and bottom surfaces or faces of shuttle valve body 64 respectively carry upper and lower switch brackets 92, 94 respectively mounted thereon. Brackets 92, 94 are step-like or U-shaped in appearance and each includes a centrally-defined aperture for loosely accepting rod 58. Upper switch bracket 92 provides an abutment face about its central aperture for one end of a compression spring 96 disposed encirclingly about rod 58 and extending partially into the upper-disposed end of shuttle piston 80 as best seen in FIG. 12.

Each of switch brackets 92, 94 supports a reversing switch assembly 98 including a plunger 100 axially-movably journaled within a hollow or well 102 defined in the bracket. A spring 104 encircles the central portion of plunger 100 to normally urge the plunger upwardly along well 102, while a dowel pin 106 in the switch bracket serves to retain plunger 100 against spring-urged movement outwardly from the well. Each plunger carries—at its axially opposite ends—a latch release button 108 projecting upwardly from well 102 normally beyond the switch bracket and a conical tip 110 arranged to protrude at least partially through and from the lower, somewhat constricted termination of well 102.

Referring specifically to FIG. 11, a piston latch body 112 is slidably positioned within a cutout of each of the switch brackets 92, 94 immediately below and communicating with the lower end of well 102. Latch body 112 is arranged for sliding movement in a direction substantially perpendicular to the axial movability of plunger 100. In addition, a tapered notch in body 112 is conformingly sized to accept plunger tip 110. Thus, plunger 100 is vertically movable while latch body 112 is horizontally slidable along the upper face of valve body 64.

Latch body 112 is further provided with a latching finger 114 in confronting relation to end cap rim 88, and the presence of a latch spring 116 normally urges finger 114 on body 112 radially inward toward central rod 58. However, its radially inward movement is constrained by the projection of plunger tip 110 which continuously extends at least partially into the tapered notch of latch body 112.

Returning now to the illustrative body washer apparatus 12 incorporating prime mover 10, a height adjustment rack 118 is mounted on shuttle valve 30 and extends vertically along fourth cylinders 42, 54 adjoining valve 30. A splash guard 120 at least in part constituting a brush support frame is vertically adjustably coupled to rack 118 as by the use of a dove-tail slot and key arrangement. Manually-rotatable locking screws 122 may be provided for securing a desired height adjustment of the brush assembly along rack 118 as will hereinafter become clear. Splash guard 120 is seen in FIG. 2 to include end bracket portions fitting peripherally and relatively loosely about guide rods 24, 26.

Splash guard frame 120 supports a carriage assembly 124 which includes a contoured brush 126 horizontally disposed for axially-centered rotation. More particularly, and referring now to FIGS. 9 and 10, brush 126 includes an internal, formed core and a brush shaft 130 protruding from opposite ends thereof. Each shaft end may be notched for convenient, detachable engagement with an appropriately-disposed dowel key 132 so as to facilitate brush interchangeability or substitution. A cover plate or shield 133 carried on frame 120 has a central opening through which brush 126 protrudes to an extent sufficient for cleansing and massaging contact with a user of the apparatus 12 (FIGS. 1 and 2).

Figure 10:
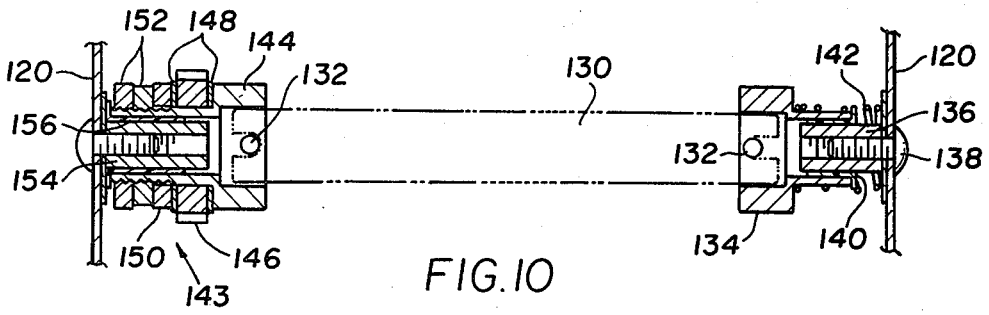
FIG. 10 is a front sectional detail of the brush mounts in the assembly seen in FIG. 9.

Suitable structures for rotatably and detachably supporting brush 126 are illustrated in FIG. 10. As thereshown the righthand end of shaft 130 is received within a brush retainer sleeve 134. Sleeve 134 is itself supported on frame or housing 120 by a spacer dowel 136 fixed to the frame wall as by retaining screw 138. A bushing 140 of nylon—which exhibits advantageous self-lubricating properties—or the like is interposed supportingly between dowel 136 and sleeve 134 to enable relative rotation therebetween. Retainer sleeve 134 is normally urged inwardly from frame 120 by a spring 142 so as to maintain brush 126 in firmly supported relation between opposed keys 132.

The lefthand brush support seen in FIG. 10 comprises a clutch-type assembly 143 including clutch shaft 144 having an opening for accepting the notched end of brush shaft 130 therein. A gear wheel or pinion 146 is disposed about clutch shaft 144 and between a pair of clutch facing washers 148. Pinion 146 is arranged to operatively mate with power transfer rack 28 for effecting rotation of brush 126 as the prime mover assembly 10 reciprocates along guide rods 24, 26. The integral clutch assembly enables the brush to "slip" in its rotation with respect to pinion 146 in the event that brush rotation is somehow prevented or hindered.

The remainder of clutch assembly 143 is comprised of a clutch plate washer 150 and a pair of lock nuts 152, all disposed about clutch shaft 144. A spacer dowel 154 fixedly mounted on frame 120 supports clutch shaft 144 through a nylon bushing 156 interposed and enabling relative axial rotation therebetween.

Operating liquid is fed to prime mover assembly 10 through an inlet line or tube 158 which extends from distribution valve 18 to inlet passage 68 on shuttle valve body 64. After operating passage through shuttle valve 30 and either upper reservoir 32 or lower reservoir 34—as will hereinafter be fully described and clearly understood—the liquid exits valve body 64 through outlet passage 70 and is carried by a distribution line or hose 160 to an adjustable diverter valve 162. Valve 162 is manually adjustable by rotation of knob 163 to selectively distribute operating liquid entering through distribution line 160 between its primary outlet feeding a spray manifold 164 (FIG. 9) and a waste exhaust conduit 166. Spray manifold 164 preferrably extends the full length of brush 126 and includes a plurality of apertures 168 communicating with its interior for directing a fine spray of manifold-fed operating liquid fed onto brush 126.

Operation of the prime mover assembly 10—and particularly of its shuttle valve 30—can be readily understood by referring to FIGS. 3, 11, 12 and 13. Looking first to FIG. 3—wherein the assembly 10 is shown in its entirety—the same extends vertically between upper and lower mounting brackets 20, 22 which are fixed on the surface of supporting wall W. The length of prime mover assembly 10 is accordingly fixed, central rod 58 spanningly connecting brackets 20, 22 to substantially define the constant length of the prime mover along its rectilinear axis.

As operating liquid is channeled into shuttle valve 30, the same is caused to reciprocate along the substantially vertical, rectilinear axis of travel—first in one direction, and then in the other. In the course of each such movement, one of the reservoirs 32, 34 expands in volume by relative sliding movement of its telescopingly interlocked or interleaved cylinders while the other reservoir correspondingly contracts.

For purposes of description, it is assumed that the valve 30 is initially disposed for upwardly-directed movement along the rectilinear axis—i.e., in its first mode. The operational arrangement of the elements of shuttle valve 30 for this mode of operation is shown in FIG. 11 wherein the reference arrow 170 denotes the direction of valve travel. As so illustrated, shuttle piston 80 is positioned at its lowermost position and is there maintained by engagement of latching finger 114 with the upper end cap rim 88. Spring 116 insures retention of this latch finger-held engagement as the piston latch body 112 is urged rightward in the Figure.

Operating liquid fed through valve inlet passage 68 is communicated to central bore 66 intermediate upper and lower switching rings 82, 84. The location of these switching rings in the illustrated, so-called first limit position of shuttle piston 80 causes liquid entering central bore 66 to be directed through lower feed passage 78 and thence into the lower reservoir 34. It will be immediately recognized that as feeding of operating liquid to lower reservoir 34 continues it causes the same to expand so that its interior volume is sufficient to accommodate the liquid received. Relative telescopic sliding of its interleaved cylinders with respect to fixed mounting bracket 22 under liquid-forced expansion of lower reservoir 34 carries shuttle valve 30 in the upward direction of travel indicated by arrow 170.

Since the overall length of prime mover assembly 10 between brackets 20, 22 must remain constant, expansion of lower reservoir 34 necessarily requires a corresponding contraction or volumetric reduction of upper reservoir 32. Assuming that the upper reservoir already contains liquid from an immediately-preceding downwardly-directed operating cycle, this operating liquid must be evacuated from the upper reservoir in order to enable its contraction. As seen in FIG. 11, the downwardly-latched, first operating position of shuttle piston 80—and corresponding placement of upper and lower switching rings 82, 84—accordingly delineates a communication path between upper feed passage 76 and upper discharge passage 72 through central bore 66 whereby contraction of the upper reservoir causes liquid therein contained to be discharged through the valve body 64 by way of outlet 70.

More particularly, upper switching ring 82 in this first position of the shuttle piston is intermediately disposed between upper feed passage 76 and inlet passage 68 while one end cap 86 closes the upper end of bore 66. Liquid forcibly discharged from upper reservoir 32 through feed passage 76 is therefore directed to outlet 70 through upper discharge passage 72. This position of upper switching ring 82 also serves to prevent and block undesired admixture between incoming liquid directed to the expanding lower reservoir and outgoing liquid discharged from the contracting upper reservoir. At the same time, the location of lower switching ring 84 is effective for channelling incoming operating liquid to the lower reservoir while blocking or sealing the opening of lower discharge passage 74 against communication with the incoming liquid.

Lower reservoir 34 attains its maximally-expanded condition when shuttle valve body 64 reaches its substantial upper limit position along the rectilinear axis. The double-headed arrow 172 in FIG. 8 denotes the full travel range along which the valve body 64 is movable in the apparatus shown. It should be noted that the term maximally-expanded as herein used does not necessarily correspond or refer to that volumetric expansion of the reservoirs whereby the interleaved cylinders are mutually telescoped to their greatest possible extent. Maximum extension is instead determined by the separation distance between spaced-apart support brackets 20, 22. Put another way, expansion of the reservoir receiving operating liquid—and corresponding reservoir carried-travel of shuttle valve 30—can continue only until the other or oppositely-disposed reservoir-delineating cylinders attain their fully collapsed condition. At this latter point a reversal in the travel direction of valve 30 is necessary for continued operation of the prime mover assembly 10 and body washing apparatus 12.

FIG. 11 illustrates the first operative mode of shuttle valve 30, immediately before it reaches the uppermost or limit position of upward-directed travel. As upward travel continues therebeyond, the upper latch release button 108 contacts and is driven into abutment against switch plate 62 of the third upper cylinder 40, causing its plunger 100 to be driven downwardly against the force of spring 104. The conical tip 110 of plunger 100 thereby descends into the frustoconical well in latch body 112, the tapered surface of plunger tip 110 advancing along the correspondingly tapered surface of the well to forcibly cause latch body 112 to slide leftward in FIG. 11 against the urgency of spring 116. This leftward movement is sufficient to fully retract finger 114 from its condition of engagement with end cap rim 88, unlatching and freeing shuttle piston 80 for relative axial movement along central bore 66.

At the instant at which shuttle piston 80 is unlatched by retraction of finger 114, operating liquid continues to be channeled or directed into lower reservoir 34. However, the lower reservoir has at this point already reached its maximally-expanded condition and liquid entering central bore 66 of valve body 64—unable to be accommodated within lower reservoir 34—acts on upper switching ring 82 to force shuttle piston 80 relatively upward along the bore.

FIG. 12 depicts piston 80 at a position intermediate its opposite limit points of travel. Here, the unlatched piston has already begun its upward, switching movement for reversing the direction of travel of shuttle valve 30. At this intermediate switching position, upper and lower rings 82, 84 are seen to sealingly block the throughbore-communicating ends of upper and lower feed passages 76, 78, respectively whereby operating liquid fed to the valve through inlet passage 68 is prevented from reaching either of the reservoirs outlet passage 70. Those skilled in the art will, however, recognize the possibility of piston 80—having reached the FIG. 12 position—becoming "stuck" in the condition shown.

To avoid such possibility, air springs 56 are preferably provided for assisting the reversing or switching movement of shuttle piston 80. In the particular situation currently of interest—i.e. switching from upward (first mode) to downward (second mode) shuttle valve travel—air spring 56 disposed in first lower cylinder 48 contributes to this switching movement. Air spring 56 is somewhat compressed as operating liquid is fed fom its pressurized source into lower reservoir 34 to cause its volumetric expansion. When piston movement to the intermediate position of FIG. 12 cuts off the flow of additional liquid to the reservoir, however, the resulting decrease in internal reservoir pressure causes the air containing structure 56 to expand in the manner of a spring; this expansion is furthermore of sufficient extent to exert an upward, moving force against the lower-disposed end cap 86, thereby contributing to upward switching motion of piston 80.

As shuttle piston 80 approaches the limit position of its upward travel, the tapered surface 90 of lower end cap 86 engages a corresponding taper of latching finger 114 on body 112, forcing the lower latch body 112 to slide leftward against the urgency of its spring 116. Once the continuing downward travel of lower end cap rim 88 carries the same beyond and clear of finger 114, latch body 112 is returned rightward by spring 116 to its radially inward position whereby lower finger 114 latches shuttle piston 80 in its second or fully upward condition.

This upwardly-latched condition of shuttle piston 80 is seen in FIG. 13 wherein reference arrow 174 denotes the downward (second mode) travel direction of shuttle valve 30. It should be readily apparent that the positioning of upper and lower switching rings 82, 84 in FIG. 13 causes incoming operating liquid to be directed to upper reservoir 32, such that the same begins to expand and carry shuttle valve 30 relatively downward. At the same time, the liquid already contained in lower reservoir 34 is forcibly discharged therefrom through passages 78, 74 and 70. Automatic switching of the shuttle piston 80 to return the same to its downwardly latched, first position for subsequent upward motion of shuttle valve 30 is effected in the same manner as that just described except that contact of the lower reversing switch assembly 98 with the lower switch plate 62 initiates the process.

When the supply of operating liquid to shuttle valve 30 is terminated, valve 30 will generally descend under its own weight to the lower limit of its permissable travel. When this cutoff of operating liquid occurs during upwardly-directed travel, first mode of valve body 64, shuttle piston 80 merely remains latched in its first position seen in FIG. 11, and a subsequent resupply of operating liquid to valve inlet passage 68 causes resumption of upwardly-directed travel.

When the supply of operating liquid is removed or cut off during downwardly-directed travel, however, descent of the shuttle valve to its lowermost position—whereby lower latch release button 108 abuttingly contacts switch plate 62 of third lower cylinder 52—shuttle piston 80 is thereby unlatched and might move only to the intermediate or null condition shown in FIG. 12. In such an event, subsequent resupply of operating liquid to shuttle valve 30 will prove ineffective insofar as its operative movement is concerned since liquid feed passages 76, 78 providing communication paths between central bore 66 and the corresponding reservoirs 32, 34 are sealed shut by rings 82, 84.

The provision of compression spring 96 is intended to prevent such an occurrence. With shuttle piston 80 in its upwardly-latched condition seen in FIG. 13, spring 96 is compressed to such an extent that unlatching of the lower end cap 86 causes relative downward acceleration of the piston under the urgency of the spring. This acceleration is sufficient to drive piston 80 at least past the null or intermediate passage-sealing condition illustrated in FIG. 12. As a consequence, resupplied operating liquid subsequently fed into inlet passage 68 is directed to lower reservoir 34 through lower feed passage 78, causing expansion of the lower reservoir and upward movement of the shuttle valve 30.

The manner of operation of the body washing apparatus 12 incorporating the inventive prime mover assembly 10 should be apparent. The brush-carrying splash guard frame 120 is vertically slidable along adjustment rack 118 for selectively varying its height; The range of adjustment is illustratively denoted by the double-headed arrow 176 in FIG. 8. Axial rotation of the contoured cleaning brush 126 about its horizontal axis is effected automatically by coupled engagement between pinion 146 and power transfer rack 28 as shuttle valve 30 is reciprocated along its rectilinear travel axis. Operating liquid discharged from prime mover assembly 10 through outlet passage 70 is distributed to spray manifold 164 and thence onto rotating brush 126 for facilitating cleansing of the user's skin.

Figure 14:
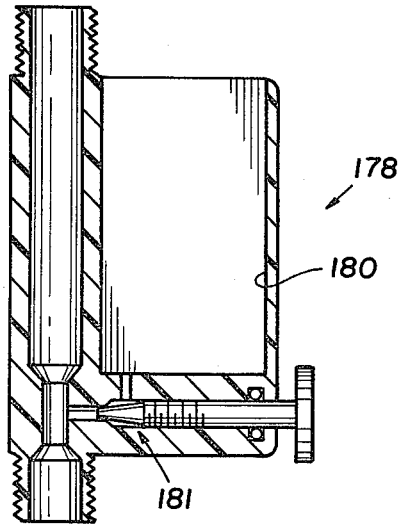
FIG. 14 is a front elevational section of an auxiliary soap dispenser for use with the body washing and massaging apparatus of the invention.

It is further within the contemplation of the invention that the operating liquid sprayed onto brush 126 from manifold 164 be first mixed with soap to further facilitate body cleansing. For such purpose, a soap dispenser generally designated 178 and seen in FIGS. 9 and 14 may be connected between liquid distribution line 160 and adjustable diverter valve 162. Soap dispenser 178 may, by way of example, include a container 180 for holding a supply of liquid or powdered soap concentrate and an adjustable valve means 181 for selective variation of the amount of soap to be mixed with the operating liquid fed to rotating brush 126.

The disclosed prime mover assembly of the invention provides a number of particularly advantageous features and operating characteristics. For one thing, the location of the shuttle or switching valve 30 intermediately along the rectilinear extension of the assembly such that the valve is carried through a resulting reciprocating motion provides a noteworthy construction of relative simplicity whereby the possibility of operating difficulties and problems is minimized. Likewise, since all of the switching mechanisms are contained on and as a portion of the shuttle valve structure, there is no need for otherwise complex and remotely positioned switching actuators or assemblies at the limit positions of rectilinear travel—nor are cables or auxiliary gearing arrangements required for such purposes.

The operating liquid may comprise any suitable substance, and may even be implemented by a gas or other fluid as the particular application dictates. The pressure under which operating fluid is fed to the prime mover determines its rate of reciprocating movement, whereby the travel speed of shuttle valve 30 increases with the fluid pressure.

Moreover, prime mover assembly 10 is capable of carrying any manner of device which it is desired to reciprocate along a rectilinear axis. Thus, the body washing and massaging apparatus 12 herein taught merely constitutes an exemplary structure embodying and utilizing the inventive prime mover 10.

Of course, the inventive assembly 10 is particularly well suited to the body washing application disclosed. Washing apparatus 12 is operated solely by the liquid fed under pressure to shuttle valve 30 and there is accordingly no danger whatsoever of electrical shock. Furthermore, there are virtually no exposed moving parts and the possibility of mechanically-related injury is likewise practically non-existent. The relative simplicity of the disclosed prime mover assembly additionally enables its operation at notably low levels of operating liquid pressure.

While there have been shown and described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A liquid-operated reciprocating prime mover assembly, comprising:

upper reservoir means for alternatingly receiving and discharging an operating liquid and being axially expandable in one direction as liquid is received therein and axially contractable in the opposite direction as liquid is discharged therefrom;

lower reservoir means for alternatingly receiving and discharging an operating liquid and being axially contractable in said one direction and axially expandable in said opposite direction as liquid is respectively discharged therefrom and received therein;

said one and opposite directions defining a rectilinear axis for reciprocation of said prime mover assembly;

valve means disposed intermediately and connectingly between said upper and lower reservoir means and including passage means communicating with the interiors of each said reservoir means for directing operating liquid from a supply source thereof alternatingly into said upper and said lower means to effect reciprocating movement of said valve means along said rectilinear axis; and cleaning brush means carried on said valve means for reciprocation along said rectilinear axis;

said valve means including discharge means for directing operating liquid alternately discharged from said upper and from said lower reservoir means through said valve means and onto said cleaning brush means for facilitating cleaning action of said brush means.

2. In an apparatus for facilitating cleansing of a user's body and including operatively rotatable brush means for reciprocation along a rectilinear axis, and rack means defining the rectilinear axis, the improvement comprising a liquid-operated prime mover assembly for carrying the brush means reciprocatingly along said rectilinear axis of the rack means, said prime mover assembly comprising:

upper reservoir means for alternatingly receiving and discharging an operating liquid and being axially expandable in one direction along said rectilinear axis as liquid is received therein and axially contractable in the opposite direction along said axis as liquid is discharged therefrom;

lower reservoir means for alternatingly receiving and discharging an operating liquid and being axially contractable in said one direction and axially expandable in said opposite direction as liquid is respectively discharged therefrom and received therein; and valve means disposed intermediately and connectingly between said upper and lower reservoir means and including passage means communicating with the interiors of each said reservoir means for directing operating liquid from a supply source thereof alternatingly into said upper and said lower means to effect reciprocating movement of said valve means and the brush means carried thereon along said rectilinear axis.

3. In an apparatus for facilitating cleansing of a user's body according to claim 2, said valve means including a valve body within which are defined said passage means and a central bore communicating with said passage means, and a shuttle piston arranged for axially reciprocating movement in and along said central bore.

4. In an apparatus for facilitating cleansing of a user's body according to claim 3, said shuttle piston being movable along said bore between first and second positions and carrying passage closure means for cooperative closure of predetermined portions of said passage means such that operating liquid is alternatingly directed to said upper reservoir means in said first position and to said lower reservoir means in said second position of the shuttle piston.

5. In an apparatus for facilitating cleansing of a user's body according to claim 4, said valve means further including releasable means for latching the shuttle piston alternatingly in said first and second positions.

6. In an apparatus for facilitating cleansing of a user's body according to claim 5, each of said upper and lower reservoir means including reversing means at a location therein axially remote from its connection to said valve means, and said latching means including releasing means operable by contact engagement with said reversing means to unlatch the shuttle piston from one of said first and second positions thereof and enable its movement to its other position for reversing the direction of movement of said valve means along said rectilinear axis.

7. In an apparatus for facilitating cleansing of a user's body according to claim 6, each said reversing means comprising an air spring disposed in said respective upper and lower reservoir means such that movement of said valve means in one of said directions along said rectilinear axis carries the same into contact engagement between said releasing means thereon and said reversing means in the respective reservoir means as the respective reservoir means reaches a substantially fully contracted condition thereof.

8. In an apparatus for facilitating cleansing of a user's body according to claim 4, said passage means including an inlet passage for directing operating liquid into said central bore, an outlet passage for conducting discharged liquid from the central bore, an upper feed passage for communicating operating liquid between the central bore and said upper reservoir means, and a lower feed passage for communicating operating liquid between the central bore and said lower reservoir means.

9. In an apparatus for facilitating cleansing of a user's body according to claim 8, said passage closure means comprising at least a liquid-directing portion on said shuttle piston of relatively enlarged cross-section moveable into and out of sealing relation with at least one of said upper and lower feed passages and said outlet passage to effect a closure thereof with respect to said central bore.

10. In an apparatus for facilitating cleansing of a user's body according to claim 8, said piston closure means comprising a pair of relatively spaced annular rings on said shuttle piston of relatively enlarged cross-section and moveable with said piston into and out of sealing relation with said upper and lower feed passages, such that in said first position of the shuttle piston said rings are positioned in said central bore so as to channel operating liquid from the inlet passage to the lower feed passage through the central bore for causing expansion of said lower reservoir means and to enable discharge of operating liquid from said upper reservoir means by effecting communication between the upper feed passage and the outlet passage through the central bore, each of said rings being effective to seal a respective one of the upper and lower feed passages at a position of said shuttle piston intermediate said first and second positions thereof along the central bore.

11. In an apparatus for facilitating cleansing of a user's body according to claim 10, said outlet passage including interconnected upper and lower discharge portions for receiving discharged operating liquid from said upper and lower reservoir means, respectively.

12. In an apparatus for facilitating cleansing of a user's body according to claim 3 and further comprising:

guide means extending through said upper and lower reservoir means and the central bore of said valve body for facilitating said reciprocating rectilinear movement of said valve means, and said shuttle piston being loosely journaled on said guide means.

13. In an apparatus for facilitating cleansing of a user's body according to claim 12, said guide means comprising an elongated rod axially disposed within said upper and lower reservoir means and valve body and extending throughout the same to define a substantially constant length of said prime mover assembly along its rectilinear axis whereby said upper and lower reservoir means are alternately operatively expanded and contracted by corresponding amounts to maintain said constant length of the assembly.

14. In an apparatus for facilitating cleansing of a user's body according to claim 2, each of said upper and lower reservoir means comprising a plurality of interengaging and relatively slidable cylinders bounding an interior chamber for expandingly receiving and contractingly discharging operating liquid.

15. In an apparatus for facilitating liquid cleansing of a user's body, operatively rotatable brush means for reciprocation along a rectilinear axis, rack means defining said rectilinear axis, and liquid-operated prime mover means for carrying said brush means along said rectilinear axis and for reversing its direction of rectilinear movement at limit positions oppositely disposed along said axis, said prime mover means including upper reservoir means for alternatingly receiving and discharging an operating liquid and being axially expandable in one direction as liquid is received therein and axially contractable in the opposite direction as liquid is discharged therefrom, lower reservoir means for alternatingly receiving and discharging an operating liquid and being axially contractable in said one direction and axially expandable in said opposite direction as liquid is respectively discharged therefrom and received therein, and valve means disposed intermediately and connectingly between said upper and lower reservoir means and including passage means communicating with the interiors of each said reservoir means for directing operating liquid from a supply source thereof alternatingly into said upper and said lower means to effect reciprocating movement of said valve means along said rectilinear axis.

16. In an apparatus for facilitating liquid cleansing of a user's body in accordance with claim 15, means on said rack means for causing operative rotation of said brush means as the same reciprocates along said rectilinear axis.

17. In an apparatus for facilitating liquid cleansing of a user's body in accordance with claim 15, said brush means including a brush, means rotatably supporting said brush, and clutch means between said brush and said support means for disabling normal rotation of said brush as the brush is reciprocated along said rectilinear axis when normal brush rotation of predeterminately impeded.

18. In an apparatus for facilitating liquid cleansing of a user's body in accordance with claim 15, said brush means including a brush, an operatively rotatable support for said brush, and means for directing operating liquid discharged from said prime mover means through said brush means for discharge through said brush so as to enable enhanced cleansing of a user's body as the operatively rotating brush contacts the user's body.

19. In an apparatus for facilitating liquid cleansing of a user's body in accordance with claim 18, adjustable means communicating with said liquid directing means for selectively mixing a cleansing material with liquid directed for discharge through said brush.

20. In an apparatus for facilitating liquid cleansing of a user's body in accordance with claim 15, said brush means being adjustably mounted on said valve means for reciprocating movement with said valve means along said rectilinear axis.

* * * * *